US008984703B1

(12) United States Patent
Hull

(10) Patent No.: US 8,984,703 B1
(45) Date of Patent: Mar. 24, 2015

(54) FOOT DEPLOYED MOP

(76) Inventor: David C. Hull, Granite Bay, CA (US)

( * ) Notice: Subject to any disclaimer, the term of this patent is extended or adjusted under 35 U.S.C. 154(b) by 188 days.

(21) Appl. No.: 13/419,758

(22) Filed: Mar. 14, 2012

(51) Int. Cl.
*A47L 13/258* (2006.01)

(52) U.S. Cl.
USPC ..... 15/227; 15/147.1; 15/229.6; 15/231

(58) Field of Classification Search
None
See application file for complete search history.

(56) References Cited

U.S. PATENT DOCUMENTS 3,699,672 A 10/1972 Sims
4,893,369 A * 1/1990 Johnson ..... 15/119.2
5,922,140 A * 7/1999 Wills ..... 134/6
D425,680 S 5/2000 Payne
6,446,300 B1 9/2002 Sleezer
7,028,364 B2 4/2006 Policicchio et al.
2006/0200927 A1 9/2006 Kacher et al.
2007/0020020 A1* 1/2007 Bobrosky et al. ..... 401/9
2007/0061985 A1* 3/2007 Fischer ..... 15/147.2
2011/0265277 A1 11/2011 Elizondo et al.

* cited by examiner

*Primary Examiner* — Monica Carter
*Assistant Examiner* — Stephanie Berry
(74) *Attorney, Agent, or Firm* — Thomas R. Lampe

(57) ABSTRACT

A foot deployed mop includes hingedly connected panel members having a pad connected to them. A foot engagement structure attached to one of the panels is engaged by a user's foot to move the panels between a non-use configuration and a use configuration.

12 Claims, 3 Drawing Sheets

FOOT DEPLOYED MOP

TECHNICAL FIELD

This invention relates to a mop and more particularly to a mop that readily converts between a compact non-use configuration for storage and other purposes and a use configuration wherein the mop is employed to mop a floor. These changes in configuration may be accomplished hands-free by employing a user's foot. Furthermore, a user's foot is employed when using the mop for mopping a floor.

BACKGROUND OF THE INVENTION

Conventional mops usually include a handle which is engaged by the user's hands to manipulate the mop. Such arrangements are relatively large and users typically have to store the mop in closets or in other out of the way spaces.

As compared with these conventional mops, the mop of this invention is deployed and operated by a user's foot and has a compact storage configuration. Prior art floor cleaning tools operated by a user's foot are known. The following references are believed to be representative of the prior art of this type: U.S. Pat. No. 6,446,300, issued Sep. 10, 2002, U.S. Patent App. Pub. No. US 2011/0265277, published Nov. 3, 2011, U.S. Patent App. Pub. No. US 2006/0200927, published Sep. 14, 2006, U.S. Design Pat. No. D425,680, issued May 23, 2000, U.S. Pat. No. 3,699,672, issued Oct. 24, 1972, U.S. Pat. No. 7,028,364, issued Apr. 18, 2006.

The above-identified references do not suggest or disclose the unique structural elements and cooperative relationships therebetween of the foot deployed mop disclosed and claimed herein.

DISCLOSURE OF INVENTION

The foot deployed mop of this invention includes a first panel member having spaced edges.

The mop also includes a second panel member having spaced edges.

The first and second panel members are hingedly connected together between adjacent edges thereof enabling relative pivotal movement between the first and second panel members between a first configuration wherein the first and second panel members are disposed substantially vertically and in opposition to one another and a second configuration wherein the first and second panel members are disposed side by side and substantially co-planar.

A pad or other floor engagement structure is attached to the first and second panel members. The floor engagement structure is positioned between the first and second panel members when the first and second panel members are in the first configuration and positioned under the first and second panel members to engage a floor to mop the floor when the first and second panel members are in the second configuration.

Other features, advantages and objects of the present invention will become apparent with reference to the following description and accompanying drawings.

MODES FOR CARRYING OUT THE INVENTION

Figure 1:
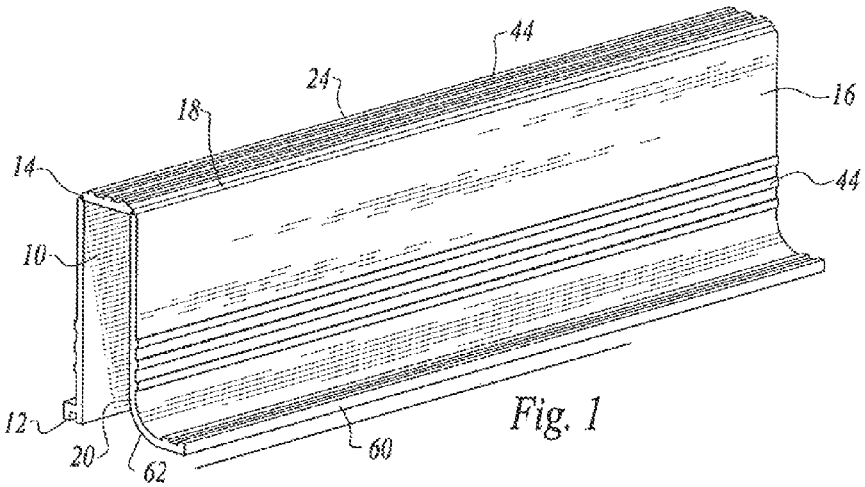
FIG. 1 is a frontal, perspective view of a first embodiment of foot deployed mop constructed in accordance with the teachings of the present invention and illustrating the relative positions assumed by the panels of the foot deployed mop when the panels are in a non-use or storage configuration.

Referring now to FIGS. 1-5 and 8-12, a foot deployed mop constructed in accordance with the teachings of the present invention includes a panel member 10 having spaced edges 12, 14 and a panel member 16 having spaced edges 18, 20.

Disposed between edges 14 and 18 of panel members 10, 16, respectively, is a third panel member 24. Panel member 24 is hingedly connected to the panel members 10, 16 to form a hinged connection between adjacent edges 14, 18. More particularly, the hinged connection is provided by live hinges 26, 28. Thus, in this embodiment the panel members 10, 16, 24 and the live hinges interconnecting the panel members are of single-piece, molded plastic construction.

Figure 4:
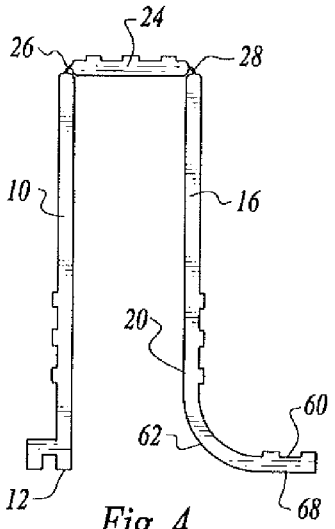
FIG. 4 is an enlarged, side, elevational view of the panel members of the foot deployed mop when in the configuration shown in FIG. 1.

The foot deployed mop panel members form a non-use, storage configuration as shown in FIGS. 1 and 4, for example, wherein the panel members 10, 16 are disposed substantially vertically and in opposition to one another.

Figure 2:
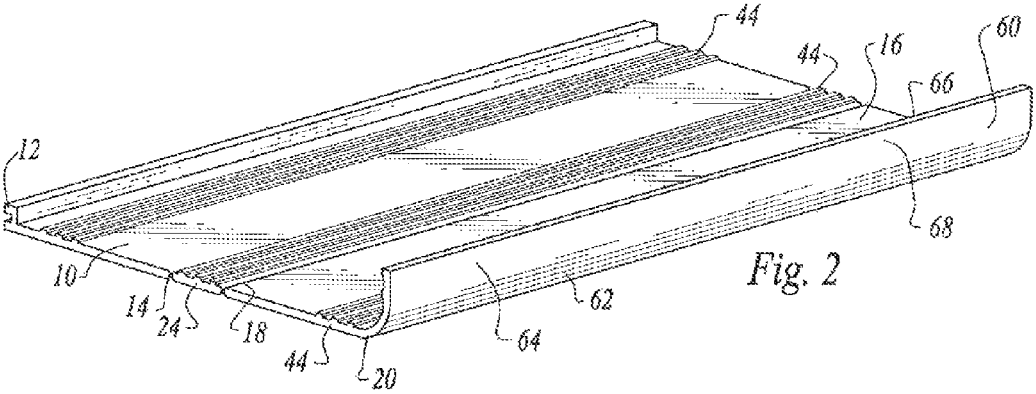
FIG. 2 illustrates the panel members in a second configuration wherein they are positioned when mopping a floor.
Figure 5:
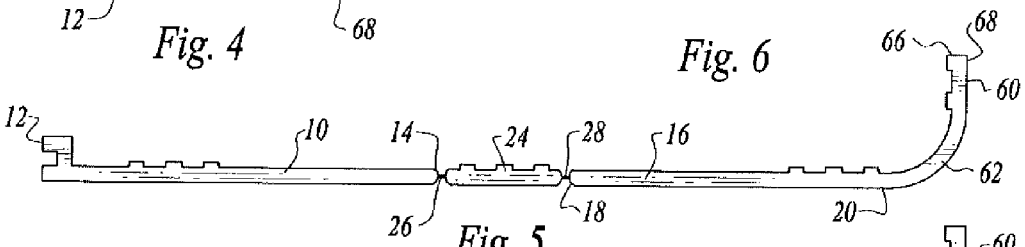
FIG. 5 is a side, elevational view of the panel members in the configuration illustrated in FIG. 2 without the cleaning pad.

FIGS. 2 and 5, for example, illustrate a second configuration, the use configuration, wherein the panel members 10, 16 are disposed side-by-side and substantially co-planar. In this embodiment of the invention the centrally disposed panel member 24 is also substantially co-planar with the panel members 10, 16.

Figure 3:
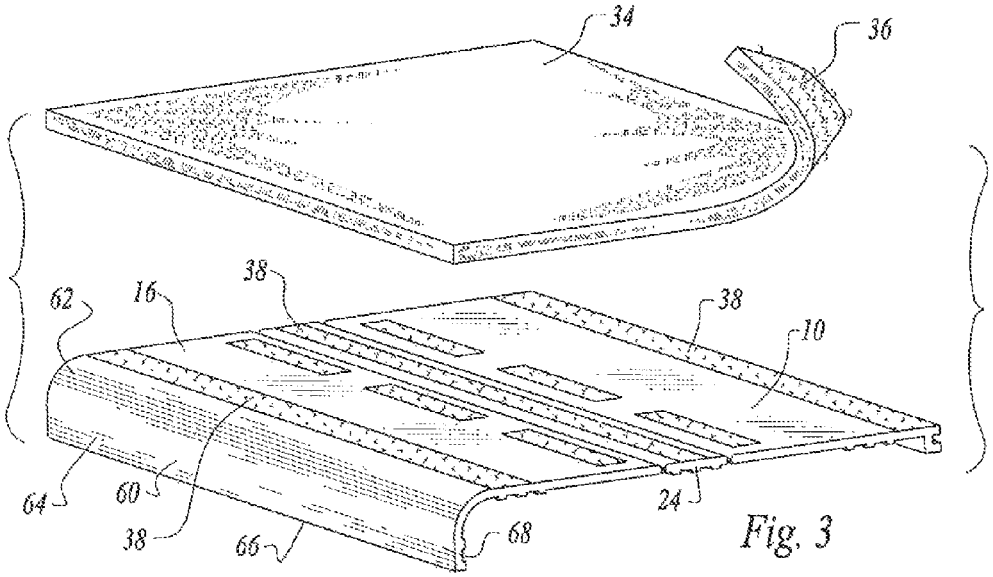
FIG. 3 is a perspective, exploded view illustrating the panel members inverted and in the configuration shown in FIG. 2 and a cleaning pad prior to releasable attachment to the panel members by synthetic hook and loop material applied to the pad and panels.

The foot deployed mop also includes floor engagement structure, which in this instance is a cleaning pad 34 of any suitable material. The cleaning pad is releasably connected to the side of the panel members which normally faces downwardly when the mop is in use. Any suitable means may be utilized to provide this releasable attachment between the cleaning pad and the panel members, however, in the embodiment illustrated in FIGS. 1-5 and 8-12 releasable attachment is accomplished by utilizing synthetic hook and loop attachment material of a well known type. In FIG. 3 the material is designated by reference numeral 36 on the pad and reference numeral 38 in the form of strips applied to the panel members.

Figure 10:
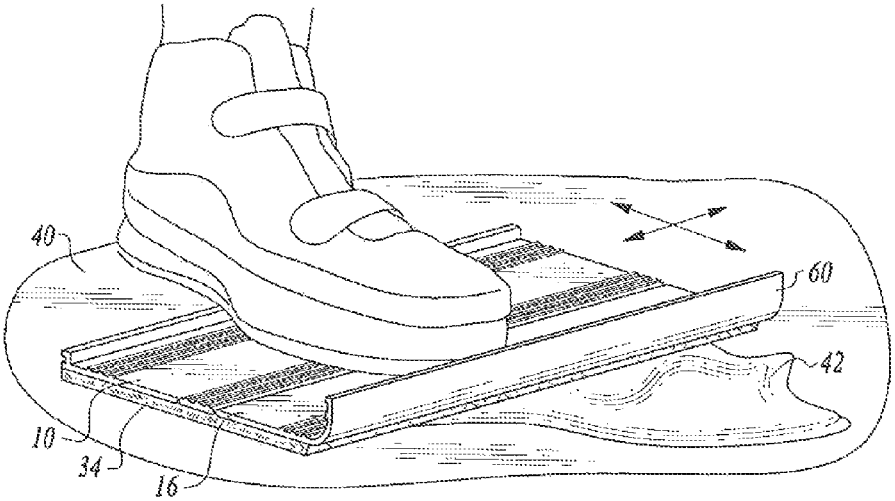
FIG. 10 illustrates a user's foot moving the fully deployed first mop embodiment relative to the floor to mop up a liquid, the mop being in its use configuration.

FIG. 10 shows the cleaning pad 34 in operative position in engagement with a floor 40. A user's foot applied to the upper surface of the panel members 10, 16, 24 can be used to maneuver the mop in a hands free manner, employing only foot power. In FIG. 10 the cleaning pad 34 is being used to mop up a spill 42. Unlike conventional mops, the user can apply pressure to a specific area of the mop, not just where a handle attaches. In the arrangement illustrated, the panel members have ribbed foot contact areas 44 which prevent slippage between the mop and a user's foot.

It will be appreciated that various types of floor engagement structures other than an absorbent pad, for example, scrubbing pads or polishing pads, may be utilized.

Figure 8:
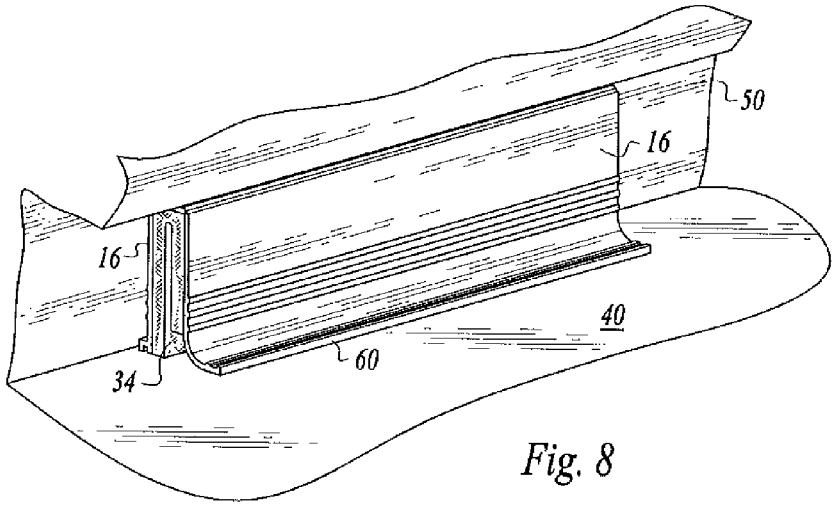
FIG. 8 illustrates the first embodiment in storage position against a vertical surface and supported by the floor.

FIG. 8 illustrates the mop, including panel members and pad 34, in the non-use configuration and positioned against a vertical surface or wall 50, the pad 34 being folded and located in the space between the panel members 10, 16. The foot deployed mop presents a pleasing appearance and has a compact configuration wherein the floor engaging surface of the cleaning pad is raised and not in engagement with the floor. The live hinges 26, 28 may be so constructed as to exert a biasing force on the panel members 10, 16 urging them toward formation of either a use or non-use configuration.

Figure 6:
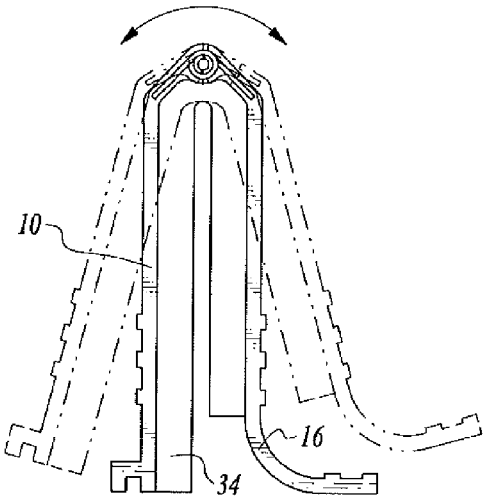
FIG. 6 is a view similar to FIG. 4, but illustrating a second embodiment employing a spring in association with the panel members for biasing the panel members and attached pad from the solid line storage configuration shown, phantom lines depicting the panel members and pad in the process of moving toward the use configuration illustrated in FIG. 2.

In the alternative embodiment of the foot deployed mop illustrated in FIG. 6, the hinge connection between panel members 10, 16 is accomplished by utilizing one or more springs 54 to provide the desired bias.

The foot deployed mop includes a foot engagement structure attached to and extending outwardly from panel member 12. The foot engagement member is in the form of a tab 60 which is fixedly attached to edge 20 of panel member 16, being integral with and projecting laterally outwardly from the panel member 16. The tab is elongated and extends along the panel member 16, the tab forming a curved floor engagement surface 62 which slidably engages a floor, facilitating movement of panel member 16 when the first and second panel members move between the use and non-use configurations. The tab includes a straight tab wall 64 with a distal end 66 and a straight tab wall surface 68 which extends from the curved floor engagement surface 62 to the distal end. The straight tab wall surface 68 engages the floor when the panel members 10, 16 are in their storage or non-use configuration.

Figure 9:
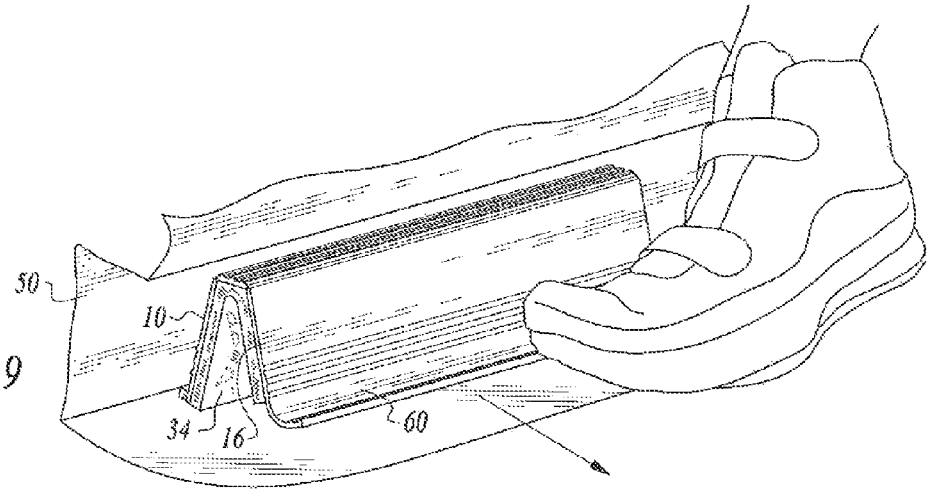
FIG. 9 illustrates a user's foot applied to the first mop embodiment and retrieving the mop by moving a panel member thereof outwardly, initiating deployment of the mop in use configuration.

FIG. 9 illustrates a user's foot engaging the tab 60 and pulling the tab and panel member 16 in the direction of the arrow to cause the panel members to move from the storage configuration to the use configuration shown in FIG. 10.

Figure 11:
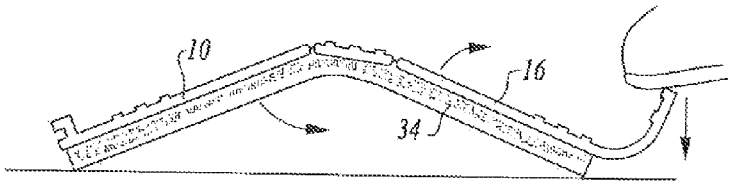
FIGS. 11 and 12 illustrate a user's foot being used to apply force to the first mop embodiment to again return it to the storage configuration shown in FIG. 5 and against a vertical surface.
Figure 12:
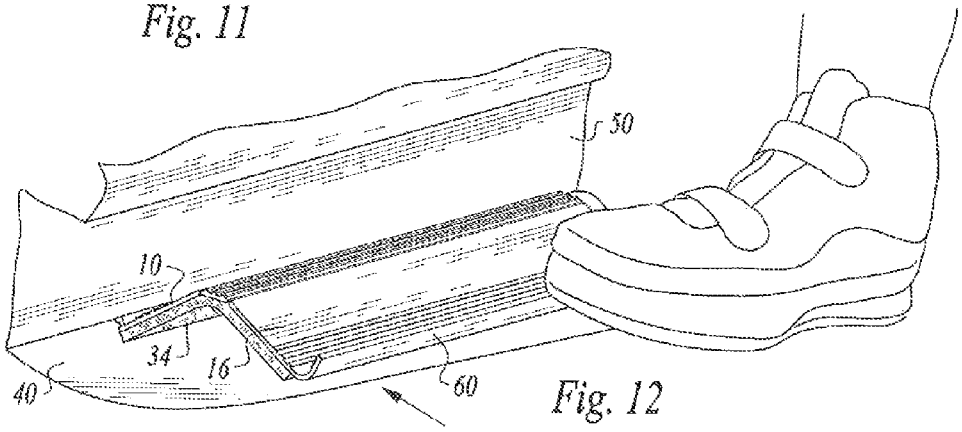

After the mop has been used, the user's foot may be utilized to return the foot deployed mop to its storage configuration. FIG. 11 illustrates the toe of a user's foot exerting a downward force on the distal end of tab 60. This causes the panels 10, 16 to move in the directions indicated by the arrows associated therewith in FIG. 11. Substantially simultaneously, the user's foot can apply a force indicated by the arrow in FIG. 12 to urge the mop against vertical surface 50 until the mop is stored in place as illustrated in FIG. 8.

Figure 7:
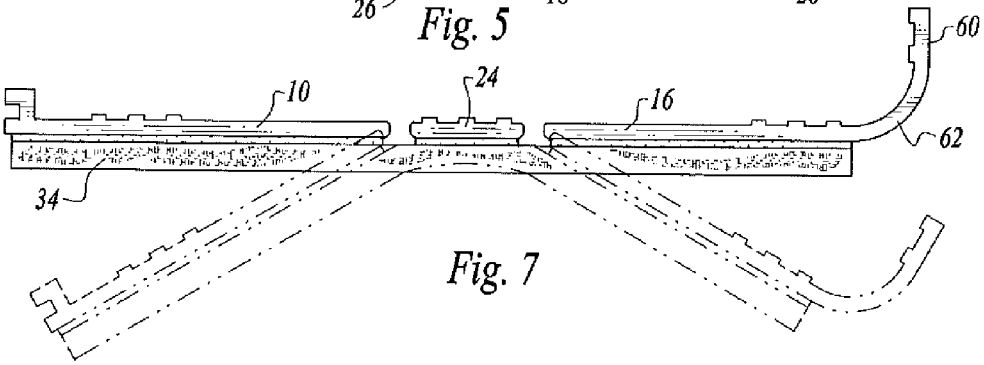
FIG. 7 is a view similar to FIG. 5, but illustrating a third embodiment of the foot deployed mop wherein the panel members are spaced separately from one another, a cleaning pad providing hinged interconnection of the panel members.

FIG. 7 illustrates a third embodiment of the invention wherein the cleaning pad 34 itself provides the hinged connection between the separated panel members 10, 16, 24, no live hinges or other type of mechanical hinge being utilized in this particular embodiment.

The invention claimed is:

1. A foot deployed mop comprising, in combination:

a first panel member having spaced edges;

a second panel member having spaced edges, said first and second panel members hingedly connected together between adjacent edges thereof enabling relative pivotal movement between said first and second panel members between a first configuration wherein said first and second panel members are disposed substantially vertically and in opposition to one another and a second configuration wherein said first and second panel members are disposed side by side and substantially coplanar;

a pad or other floor engagement structure attached to said first and second panel members, said floor engagement structure positioned between said first and second panel members when said first and second panel members are in said first configuration and positioned under said first and second panel members to engage a floor to mop the floor when said first and second panel members are in said second configuration; and a foot engagement structure attached to and extending outwardly from said first panel member, said foot engagement structure when engaged and moved by the foot of an individual operable to move said first panel member relative to said second panel member to alternatively form said first configuration and said second configuration, said foot engagement structure comprising a tab fixedly attached to and projecting laterally outwardly from said first panel member and forming a curved floor engagement surface slidably engaging a floor when the first and second panels move between said first and second configurations.

2. The foot deployed mop according to claim 1 additionally including a third panel member between the adjacent edges of said first panel member and said second panel member and hingedly connected to said first panel member and said second panel member to form the hinged connection between said adjacent edges.

3. The foot deployed mop according to claim 1 wherein said floor engagement structure extends between said first panel member and said second panel member between said adjacent edges to provide the hinged connection between said adjacent edges.

4. The foot deployed mop according to claim 1 wherein said tab is elongated and extends along said first panel, said tab including a tab wall with a distal end and having a tab wall surface extending from said curved floor engagement surface to said distal end, said tab wall surface engaging a floor when said first and second panel members are in said first configuration.

5. The foot deployed mop according to claim 1 including attachment means releasably attaching said pad or other floor engagement structure to said first and second panel members.

6. The foot deployed mop according to claim 1 wherein said first and second panel members define a space therebetween accommodating said floor engagement structure when in said first configuration.

7. The foot deployed mop according to claim 6 wherein the floor engagement structure is flexible and forms a fold when in said space.

8. The foot deployed mop according to claim 1 including live hinges between said adjacent edges hingedly connecting said first panel member and said second panel member.

9. The foot deployed mop according to claim 1 including biasing structure at the hinged connection between said first and second panel members to bias said first and second panel members to form one of said configurations.

10. The foot deployed mop according to claim 9 wherein said biasing structure comprises a spring.

11. The foot deployed mop according to claim 5 wherein said attachment means comprises synthetic hook and loop attachment material.

12. The foot deployed mop according to claim 1 wherein said floor engagement structure is raised relative to the floor and the cleaning surface thereof out of engagement with the floor when said first and second panel members are in said first configuration.

* * * * *